United States Patent [19]

Lafferty et al.

[11] 4,146,388

[45] Mar. 27, 1979

[54] MOLYBDENUM PLASMA SPRAY POWDER, PROCESS FOR PRODUCING SAID POWDER, AND COATINGS MADE THEREFROM

[75] Inventors: William D. Lafferty, Naugatuck, Conn.; Richard F. Cheney; Richard H. Pierce, both of Towanda, Pa.

[73] Assignee: GTE Sylvania Incorporated, Stamford, Conn.

[21] Appl. No.: 858,777

[22] Filed: Dec. 8, 1977

[51] Int. Cl.[2] ..... B22F 9/00

[52] U.S. Cl. ..... 75/0.5 AC; 75/0.5 BB; 75/0.5 BC; 75/252

[58] Field of Search ..... 75/0.5 BB, 0.5 BC, 252, 75/0.5 AC

[56] References Cited

U.S. PATENT DOCUMENTS

| | | | |
|---|---|---|---|
| 3,407,057 | 10/1968 | Timmons | 75/252 |
| 3,890,137 | 6/1975 | Beyer et al. | 75/0.5 BC |
| 3,909,241 | 9/1975 | Cheney et al. | 75/0.5 BB |
| 3,960,545 | 6/1976 | Port et al. | 75/0.5 BC |
| 3,973,948 | 8/1976 | Laferty, Jr. et al. | 75/0.5 BB |
| 4,011,073 | 3/1977 | Powers et al. | 75/0.5 BB |

*Primary Examiner*—W. Stallard

*Attorney, Agent, or Firm*—John C. Fox

[57] ABSTRACT

Plasma spray powders of molybdenum particles containing at least 0.5 weight percent oxygen and obtained by reacting molybdenum particles with oxygen or oxides in a plasma, form plasma spray coatings exhibiting hardnesses comparable to flame sprayed coatings formed from molybdenum wire and plasma coatings of molybdenum powder containing hardening alloy powders. Such oxygen rich molybdenum powders may be used to form wear resistant coatings, such as for piston rings.

17 Claims, 3 Drawing Figures

1Kx 2.5 weight percent oxygen

1Kx
0.01 weight percent oxygen

1Kx
2.5 weight percent oxygen

1Kx
2.2 weight percent oxygen

MOLYBDENUM PLASMA SPRAY POWDER, PROCESS FOR PRODUCING SAID POWDER, AND COATINGS MADE THEREFROM

FIELD OF THE INVENTION

This invention relates to an oxygen rich molybdenum plasma spray powder, and to a process for producing such powder, and to coatings made from such powder. The coatings combine the hardness of wire sprayed coatings and the inexpensive processing and flexibility of plasma sprayed coatings. By controlling the amount of oxygen in the molybdenum powder, the hardness of the resulting coatings can be controlled.

PRIOR ARt

Flame spraying and plasma spraying are now common techniques for the application of protective and wear resistant coatings of various metals, ceramics and cermets, usually to metal surfaces (substrates). The piston ring industry commonly uses molybdenum coatings on rings for internal combustion engines. These coatings may have been applied by a technique known as wire-spraying, i.e. an electric arc or an oxyacetylene flame melts the end of a continuous coil of molybdenum wire and a gas propels it onto a substrate (the wear surface of a cast iron piston ring) where it splats and solidifys, forming the coating in successive layers. Because of the presence of excess oxygen either from the flame, or the surrounding air or both, the coatings produced by this technique contain large quantities of oxygen (typically 7 or 8%) in solution and as various molybdenum oxides. The large quantities of oxygen in the molybdenum apparently harden the coating.

Typical wire-sprayed molybdenum coating hardnesses are 700 to 850 $DPH_{100}$ g. To duplicate the hardness and/or wear resistance of wire-sprayed molybdenum coatings when using plasma spray powders, various other metal alloy powders are added to the molybdenum powder prior to plasma spraying the coating. The resulting coating consists of two or more phases. By combining the scuff resistance of the molybdenum phase and the wear resistance of the second phase, the performance of wire-sprayed coatings is equalled or surpassed. In addition, the disadvantage of loss of molybdenum through non-adherence and/or volatilization of $MoO_3$ during wire spraying is substantially avoided. A common second phase-forming powder constituent is a nickel base alloy described in Aircraft Materials Specification AMS 4775. The combination of this alloy powder with molybdenum powder is covered in U.S. Pat. Nos. 3,313,633 and 3,378,392, assigned to Metco, Inc.

It should also be noted that in plasma spraying of molybdenum, there is usually a minimum of oxygen in the sprayed coating due to the use of an oxygen-lean plasma gas system. That is argon, helium, hydrogen, nitrogen or combinations of these gases, all of which are relatively free from oxygen, are used in the plasma spraying process. Hence, any oxygen in the sprayed coating is incidentally due to oxidation of the molten particles by oxygen impurity in the plasma gas and/or surface oxidation of the freshly deposited coating. In such "pure" molybdenum coatings the oxygen level is in the 1 to 2% range, and hardnesses are commonly 300 to 350 $DPH_{100}$ g. For higher hardnesses, therefore, a more expensive process such as wire-spraying or a more expensive powder such as molybdenum plus nickel-base alloy must be used.

SUMMARY OF THE INVENTION

In accordance with the invention, it has been discovered that the hardness and consequently the wear resistance of molybdenum flame spray coatings may be substantially increased by incorporating at least about 0.5 weight percent of oxygen into the molybdenum plasma spray powder, either as dissolved oxygen or oxide, or as a second phase containing oxygen or oxide or as a surface oxide or in some combination of these forms, prior to plasma spraying. The plasma sprayed coatings so formed exhibit improved hardnesses over those of "pure" molybdenum plasma sprayed coatings typically containing from 1 to 2 weight percent oxygen.

In accordance with the invention, such oxygen rich molybdenum powders are formed by passing molybdenum particles through a plasma, such as that formed by commercially available plasma spray guns, while the particles are in contact substantially with free oxygen or an oxide of molybdenum or a precursor of an oxide molybdenum. As used herein, the term "precursor" means a compound which on heating above a critical temperature will convert to an oxide of molybdenum, for example, the various ammonium molybdates which decomposes essentially instantaneously at plasma temperatures. Such ammonium molybdates include ammonium dimolybdate, ammonium paramolybdate, ammonium tetramolybdate, ammonium polymolybdate and normal ammonium molybdate. Other suitable precursors include by way of example, molybdenyl sulfates, molybdenyl chlorides and, in the presence of oxygen, molybdenum disulfide and molybdenum pentachloride.

According to a preferred embodiment, the oxygen content of the powder may be controlled by bleeding controlled amounts of a free oxygen containing gas such as air into the plasma such as by aspiration through a variably-sized orifice in the plasma equipment housing.

According to another preferred embodiment, the oxygen content of the powder may be further controlled by bleeding controlled amounts of a reducing gas such as hydrogen into the plasma, or subsequent to passage through the plasma, by heating the powder in a reducing atmosphere such as hydrogen to reduce molybdenum oxides to molybdenum, or by washing the powder with an oxygen leaching agent such as ammonium hydroxide.

According to still another preferred embodiment, ammonium molybdate is selected to be the precursor, which also serves as a binder for molybdenum particles in particle agglomerates, conveniently produced for example, by spray drying molybdenum particles in an aqueous ammonium molybdate solution as taught in U.S. Pat. No. 4,028,095.

In accordance with still another preferred embodiment, such ammonium molybdate-containing agglomerates may be mixed with molybdenum powder particles in order to further control the amount of oxygen incorporated into the molybdenum plasma spray powder.

Coatings produced from such plasma spray powders combine the hardness of wire-sprayed coatings and the inexpensive processing and flexibility of plasma spray coatings. By controlling the amount of oxygen in the molybdenum powder, the hardness of the resulting coatings can be controlled.

DETAILED DESCRIPTION OF THE INVENTION

Figure 1:
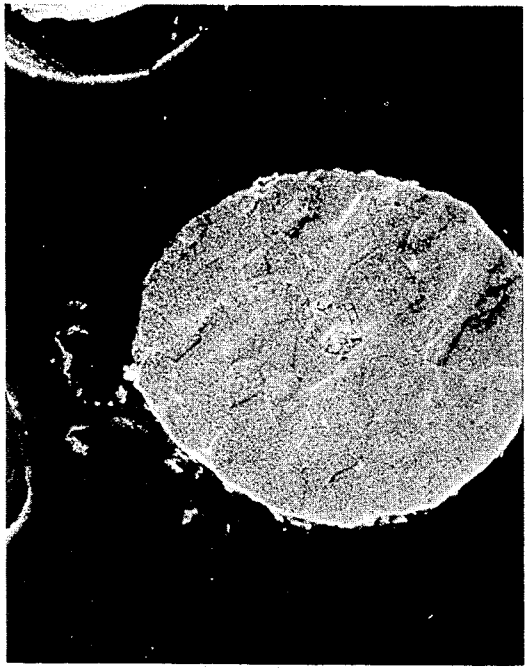
FIGS. 1 through 3 are electron micrographs of etched cross sections of molybdenum powder particles containing from 0.01 to 2.5 weight percent oxygen.

The oxygen should be present in the molybdenum plasma spray powder in a total amount of uncombined oxygen and combined oxygen as a molybdenum oxide, of at least 0.5 weight percent, below which insignificant increases in hardness of the plasma sprayed coating are obtained. Since in general, hardness, and thus wear resistance of the coating, increases with increasing oxygen content of the plasma spray powder, the upper limit of oxygen in the powder is determined by other considerations such as low yields owing to sublimation of $MoO_3$, and brittleness of the resultant coating. Based upon the above considerations, oxygen is preferably present in the powder within the range of about 2.0 to 7.0 weight percent, preferably as dissolved oxygen or dissolved molybdenum oxide. While a certain amount of oxide on the surface of the particles is tolerable, and in some cases may even be desirable in contributing to the overall oxygen level in the sprayed coating, nevertheless excessive surface oxide may be detrimental in that it cannot be completely incorporated into the molybdenum as a dissolved or second phase, and thus could remain in pockets or layers which could lead to mechanical failure of the sprayed coating. However, the powder may be treated prior to plasma spraying in order to at least partially remove excessive surface oxide.

The starting molybdenum powder may be any molybdenum powder suitable for plasma spraying operations, such as those described in U.S. Pat. Nos. 4,028,095 and 3,974,245, issued to Laferty et al. on June 7, 1977, and to Cheney et al. on Aug. 10, 1976, and assigned to the present assignee. The oxygen may conveniently be incorporated into the molybdenum particles by passing the particles through a commercial plasma spray gun while in substantial contact with free or combined oxygen.

If the starting powder is chosen to be unagglomerated molybdenum particles, the oxygen may for example be introduced by aspirating oxygen containing gas such as air into the plasma gun during passage, or by mixing the molybdenum particles with molybdenum oxide particles prior to passage through the gun.

It may be advantageous to choose agglomerates of molybdenum particles held together by a precursive binder such as ammonium molybdate, since upon heating the binder converts to molybdenum oxide, which can be taken into solution as the plasma melts the molybdenum particles.

Of course, any combination of the above techniques or other techniques known to be effective for the incorporation of oxygen into molybdenum may be used, so long as the desired level of oxygen is incorporated into the molybdenum powder prior to plasma spraying of the coating on a substrate.

Addition control of oxygen level, particularly surface oxide, may be achieved by the introduction of a reducing agent into the plasma gas, such as hydrogen alternatively, the oxygen level in the molybdenum powder may be adjusted downwardly subsequent to passage through the plasma, such as by chemical washing or heating in a reducing atmosphere.

Chemical washing is preferred for oxygen adjustment since as a room temperature process it will effectively remove only surface oxide. The removal of surface oxide not only permits better heat transfer and therefore better melting during plasma spraying, resulting in integral coatings of good mechanical strength. Reduction by heating in a reducing atmosphere such as hydrogen may be preferred in those instances where both surface oxide and internal oxygen is desired to be reduced, since after diffusion of oxide to the surface of the particles at elevated temperatures, such oxide is then reduced to molybdenum metal.

EXAMPLE I

Using agglomerated molybdenum powder and a nitrogen atmosphere in commercial plasma spray equipment, U.S. Pat. No. 4,028,095, issued to John M. Laferty, Jr., Joseph E. Ritsko and David J. Port on June 7, 1977, and assigned to GTE Sylvania, as the feed material for the process described in U.S. Pat. No. 3,974,245, issued to Richard F. Cheney, Charles L. Moscatello and Frederick J. Mower on Aug. 10, 1976, and assigned to GTE Sylvania, molybdenum plasma spray powder having 0.7% oxygen was produced. (Sample No. 3, Table I). Then by allowing air to enter the plasma chamber through a gap in the gun fixture, powder was produced having from 0.9 through 6.7% $O_2$ (Compare Sample Nos. 1 and 2; 4 and 6, Table I). Typical plasma conditions are given in Table II.

EXAMPLE II

A spray dried agglomerated green molybdenum powder feed made by the process of U.S. Pat. No. 4,028,095 containing about 16.9% of of ammonium molybdate was passed through the plasma. By this approach oxygen contents of 0.5 to 3.1% were attained (see sample numbers 7, 8, 13 and 15 in Table I). It is believed that ammonia is released leaving $MoO_3$, some of which is then taken into solution. The remainder escapes, probably as volatile $MoO_3$.

The first technique described above, i.e. spraying in aspirated air, is likely to yield powder with a concentration of oxygen on the surface of the powder particles. The second. i.e., spraying green feed powder, is likely to be more uniform in oxygen concentration throughout the particle.

EXAMPLE III

Hydrogen reduction can be used to adjust the oxygen content of the powder. As shown by comparison of oxygen content in samples 7, 11 and 12; 13 and 14; 15 and 16 in Table I, hydrogen reduction treatments at 800° C. and 900° C. can be used to alter oxygen levels in the powder.

EXAMPLE IV

Other means of controlling the oxygen content are by using mixtures of sintered and green feed powder as shown by sample numbers 9 and 10, compared to 2 and 7 in Table I, or by using a small quantity of hydrogen mixing gas with the (argon) plasma gas as shown by sample numbers 8 and 10 compared to 7 and 9 respectively. Another means of controlling oxygen content in the powder is by chemical washing such as with ammonium hydroxide as shown by a comparison of sample numbers 15 and 17.

EXAMPLE V

To more closely approach the 7 to 8% $O_2$ in wire-sprayed molybdenum coatings, yet another technique was used. The conditions used to produce sample number 15, i.e. an air atmosphere in the chamber, the top closed with no "O" rings, and green powder fed at 4.8 kg/hr, resulted in 2.5% $O_2$ in the final powder. By processing green powder in which additional $MoO_3$ had been added (by simple blending in the plasma gun powder feeder canister), i.e. 89.5% green powder plus 10.5% $MoO_3$, using plasma conditions shown in Table III and the remaining parameters of sample number 15, powders having $O_2$ contents of 5.0 to 5.8% were produced. By washing in $NH_4OH$, the $O_2$ level of 5.0% in sample number 18 was reduced to 3.9%, sample number 19.

EXAMPLE VI

Test coupons of plasma sprayed coatings were formed using the plasma spray powder, sample number 13 of Table I. Plasma spray parameters are as follows:

Nozzle — Bay State #901065
Plasma Gas — 65 scfm of Argon
Powder Gas — 4.5 scfm of Argon
Power — 750 amps, 42 volts
Powder feed rate — 9.2 lb/hr.

The resulting coatings contained about 4.9 weight percent of oxygen and exhibited a hardness with the range of about 650 to 825 $DPH_{100\,g}$. Standard molybdenum plasma spray coatings containing about 1.6 weight percent oxygen exhibit hardnesses of about 380 $DPH_{100\,g}$. It therefore appears that the increased oxygen level increases coating hardness.

EXAMPLE VII

Sample lot numbers 18 and 19 were used to spray plasma coatings on grit-blasted mild steel substrates. The plasma spray parameters used are summarized in Table III. The resulting coating hardnesses were 614 $DPH_{100\,g}$ for 18 and 630 $DPH_{100\,g}$ for 19. The oxygen contents of the powders were 5.0% and 3.9% respectively. The coating hardness for a similar powder having about 0.01% $O_2$ was 337 $DPH_{100\,g}$.

Figure 2:
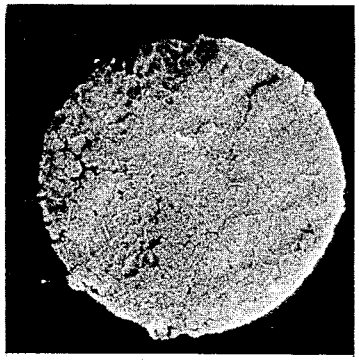
Figure 3:
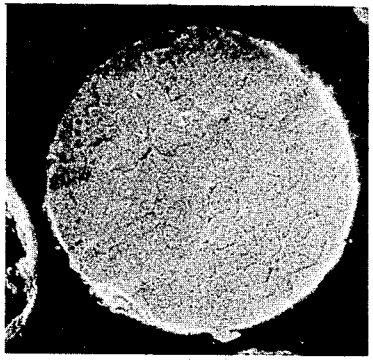

Electron micrographs of etched cross sections of molybdenum powder particles are shown in the Drawing. FIG. 1, is a picture of a molybdenum particle containing about 0.01% $O_2$. FIGS. 2 and 3 are pictures of particles made by the processes described in this invention disclosure which contain 2.0 to 2.5% $O_2$. The presence of the $O_2$ in solution in the molybdenum can be seen as a refinement in grain size and possibly, a change in the shape of the grains.

The total combined and uncombined oxygen content of the plasma sprayed coating will in general be from about 2 to 5 weight percent higher than that of the powder where such coating is formed in an oxygen-containing atmosphere, due substantially to surface oxidation of the molten particles and/or coating during deposition. Of course, such increased oxygen content may be substantially avoided by carrying out such coating operations in an inert atmosphere or vacuum.

As used herein, the term "plasma" is intended to include not only the plasma itself, but also the surrounding region which is maintained at a temperature at least equal to the oxidation temperature for molybdenum.

TABLE I

| | CONDITIONS | | | | | RESULTS | | | |
|---|---|---|---|---|---|---|---|---|---|
| Sample No. | Feed Powder | Feed Rate (Kg 1 hr.) | Glove Box Atmosphere | Gap | Post Feed Treatment | Hall Flow (sec/50g) | Bulk Dens (glcc) | Oxygen (wt.percent) | Nitrogen (ppm) |
| 1 | Sintered* | 5.6 | Air | ¼" | | 17 | 4.04 | 6.7 | 1000 |
| 2 | " | " | Residual Air | closed | | 12 | 5.00 | 0.9 | 365 |
| 3 | " | " | $N_2$ | " | | 12 | 5.06 | 0.7 | 440 |
| 4 | " | 2.5 | Air | " | | 13 | 4.82 | 1.1 | 585 |
| 5 | " | " | " | ¼" | | too much oxide | | — | — |
| 6 | " | 5.6 | " | ⅛" | | 17 | 4.03 | 4.8 | 900 |
| 7 | green** | 4.8 | Residual Air | closed | | 15 | 3.91 | 3.1 | 770 |
| 8 | " | 4.8+ | " | " | | 21 | 3.66 | 2.9 | 650 |
| 9 | ½ sintered ½ green | 5.2 | " | " | | 13 | 4.64 | 1.5 | 650 |
| 10 | " | 5.2+ | " | " | | 16 | 4.45 | 1.4 | 550 |
| 11 | Sample No. 7 | — | — | — | sample No. 7 heated 5 minutes at 800° C in hydrogen | — | — | 2.7 | 683 |
| 12 | Sample No. 11 | — | — | — | sample No. 11 heated 10 minutes at 900° C in Hydrogen | — | — | 1.3 | 386 |
| 13 | green | 4.8 | $N_2$ | closed | | 12 | 5.25 | 2.2 | 684 |
| 14 | Sample No. 13 | — | — | — | sample No. 13 heated 10 min. at 900° C in Hydrogen | — | — | — | 514 |
| 15 | green | 4.8 | Residual Air | closed | | 12 | 5.19 | 2.5 | 565 |
| 16 | Sample No. 15 | — | — | — | sample No. 15 heated 10 minutes at 900° C in Hydrogen | — | — | 1.4 | 355 |
| 17 | Sample No. 15 | — | — | — | sample No. 15 washed in conc. $NH_4OH$ | 11 | 5.25 | 2.0 | 635 |

*sintered agglomerates of molybdenum powder
**agglomerates of molybdenum powder bound with ammonium molybdate +hydrogen mixing gas

TABLE II

| | | Typical Plasma Conditions | | | |
|---|---|---|---|---|---|
| Sample No. | Chamber Atmosphere | Plasma Gas Flow Rate (1/min.) | Feed Gas Flow Rate (1/min.) | Power Amps/Volts | |
| 13 | $N_2$ | Ar 24.4 | Ar 1.75 | 600 | 32 |
| 15 | Air | Ar | Ar | 600 | 32 |

TABLE II-continued

| Sample No. | Chamber Atmosphere | Typical Plasma Conditions: Plasma Gas Flow Rate (1/min.) | Feed Gas Flow Rate (1/min.) | Power Amps/Volts |
|---|---|---|---|---|
| | | 24.4 | 1.75 | |

TABLE III

| Plasma Conditions for Production of High Oxygen Molybdenum Powder | |
|---|---|
| Nozzle | Bay State #901065 |
| Plasma Gas | Argon |
| Flow rate (1/min) | 24.4 |
| Feed Gas flow rate (1/min) | 1.7 |
| Feed Rate (kg/hr) | 1.5 |
| Power (amps) | 750 |
| (volts) | 37 |

What is claimed is:

1. A plasma spray powder consisting essentially of of molybenmum as a first phase and containing at least one member selected from the group consisting of oxygen and the oxides of molybdenum wherein combined and uncombined oxygen is present in a total amount of from about 0.5 to 15 weight percent.

2. The plasma spray powder of claim 1, containing from about 2.0 to 7.0 weight percent total of combined and uncombined oxygen.

3. The plasma spray powder of claim 1, wherein at least a portion of the at least one said member is present in a second phase.

4. The plasma spray powder of claim 1, wherein at least a portion of the at least one said member is present as a surface oxide.

5. The plasma spray powder of claim 1, wherein at least a portion of the at least one said member is dissolved in said first phase.

6. A method of producing a flame spray powder consisting essentially of molybdenum as a first phase and containing at least one member selected from the group consisting of oxygen and the oxides of molybdenum wherein combined and uncombined oxygen is present in a total amount of from about 0.5 to 15 weight percent, the method comprising:

passing molybdenum particles through a plasma while in substantial contact with an excess of at least one member selected from the group consisting of free oxygen, the oxides of molybdenum and the precursors of the oxides of molybdenum, whereby at least a portion of at least one member selected from the group consisting of oxygen and the oxides of molybdenum are incorporated into the molybdenum by reaction in the plasma.

7. The method of claim 6, wherein the plasma contains a reducing agent, whereby the content of at least one of said oxides is controlled.

8. The method of claim 6, wherein subsequent to passage through the plasma, the content of the at least one of said members is controlled.

9. The method of claim 8, wherein the content of the oxides is lowered by heating the powder in a reducing atmosphere to reduce at least a portion of said oxides to molybdenum metal.

10. The method of claim 9, wherein said reducing atmosphere comprises hydrogen.

11. The method of claim 8, wherein the oxygen content of the powder is lowered by contacting the powder with an oxygen leaching agent.

12. The method of claim 11, wherein said agent is an aqueous ammonia solution.

13. The method of claim 6, wherein air is aspirated into the plasma during passage of molybdenum particles therethrough, whereby the molybdenum particles are in substantial contact with the free oxygen during said passage.

14. The method of claim 6, wherein the molybdenum particles are in substantial contact with $MoO_3$ particles during said passage.

15. The method of claim 14, wherein said molybdenum particles are in substantial contact with ammonium molydate are passed through the plasma, whereby during said passage the ammonium molybdate is converted to $MoO_3$ in contact in substantial contact with the molybdenum particles.

16. The method of claim 15, wherein the molybdenum particles and ammonium molybdate are passed through the plasma in the form of agglomerates of molybdenum particles held together by ammonium molybdate as a binder.

17. The method of claim 16, wherein said agglomerates are produced by spray drying a slurry of molybdenum particles in an aqueous ammonium molybdate solution.

* * * * *